US005359335A

United States Patent [19]

Egashira et al.

[11] Patent Number: 5,359,335

[45] Date of Patent: Oct. 25, 1994

[54] AUTOMOBILE ANTENNA

[75] Inventors: Yoshimi Egashira, Sagamihara; Masaki Shinkawa, Kanagawa, all of Japan

[73] Assignee: Harada Kogyo Kabushiki Kaisha, Tokyo, Japan

[21] Appl. No.: 895,208

[22] Filed: Jun. 8, 1992

Related U.S. Application Data

[63] Continuation of Ser. No. 387,006, Jul. 28, 1989, abandoned.

[51] Int. Cl.[5] ..... H01Q 1/32

[52] U.S. Cl. ..... 343/715; 343/862

[58] Field of Search ..... 343/711-715, 343/901-903, 860, 862; H01Q 9/00, 1/32

[56] References Cited

U.S. PATENT DOCUMENTS 2,205,358 6/1940 Hansell ..... 343/905
4,352,107 9/1982 Kiyooka ..... 343/860

FOREIGN PATENT DOCUMENTS 115004 9/1981 Japan ..... 343/711

OTHER PUBLICATIONS

The ARRL Antenna Book, Published by the American Radio Relay League, Newington, Conn., 15th Ed., 1988, pp. 24-18 to 24-20, and 24-2 to 24-9.

Goodman, "My Feedline Tunes My Antenna", QST, Mar., 1956, pp. 49-51, 124.

National Radio Institute Communications Text CC210-11-12, 1976, pp. CC211-7 to CC211-13.

The ARRL Radio Amateur's Handbook, Published by the ARRL, Newington, Conn., Fifty-Fifth edition, 1978, pp. 624-626.

*Primary Examiner*—Michael C. Wimer
*Attorney, Agent, or Firm*—Koda and Androlia

[57] ABSTRACT

An automobile antenna including an antenna element which receives both AM and FM broadcast bands and is mounted on a vehicle body and a feeder cable having one end thereof connected to a feeding point of the antenna element and the other end to a receiver set, the feeder cable being set so that its electrical length is an integral multiple of ½ the wavelength of the FM broadcast band.

2 Claims, 6 Drawing Sheets

AUTOMOBILE ANTENNA

This is a continuation of application Ser. No. 387,006, filed Jul. 28, 1989 now abandoned.

BACKGROUND OF THE INVENTION

1. Field of the Invention

The present invention relates to an automobile antenna which is capable of receiving both AM and FM broadcasts (hereafter referred to as "AM waves" and "FM waves"), and more specifically to an automobile antenna with improved reception sensitivity.

2. Prior Art

As shown in FIG. 10, conventional AM/FM automobile antennas are generally constructed as follows: An antenna element 1, which is either extendible or not extendible, is attached to a vehicle body wall 2, and one end of a coaxial feeder cable 4 is connected to a feeding point 3 of the antenna element 1. The other end of the coaxial feeder cable 4 is connected (either directly or via a relay cable) to a receiver set 5 which is installed inside the vehicle.

The length of the coaxial feeder cable 4 is appropriately set in accordance with the physical distance between the antenna feeding point 3 and the receiver set 5 which is in turn determined by the type of the vehicle or the positional relationship between the antenna element 1 and the receiver set 5.

In the past, a $\mu$ tuning system was used exclusively as the tuning system for receiver sets. Recently, however, so-called "electronic" tuning systems have begun to be employed.

In the AM band, the conditions for coupling the antenna element 1 and the receiver set 5 differ according to the tuning system which is used. In the case of a $\mu$ tuning system, the electrostatic capacitance viewed from the plug of the feeder cable 4 is set at about 80 pF. In order to adjust the system to this electronic capacitance, a capacitor is usually inserted in series in the feeder cable 4. In the case of an electronic tuning system, there is no stipulation arising from the electrostatic capacitance and the sensitivity is increased when the electrostatic capacitance viewed from the plug of the feeder cable 4 is minimal. In the FM band, it is considered desirable that the impedance of the antenna be in the range of approximately 75 to 150 ohms, regardless of the type of tuning system.

The following problems have been found in conventional automobile antennas. Since both AM and FM waves are received by a single antenna element 1, a $\lambda/4$ grounded type antenna element (i.e. $\lambda/4$ with respect to the wavelength of the FM waves) is used for the antenna element 1. Specifically, for antennas for Japanese domestic use, an antenna element with a total length of 0.95 to 1.0 m is used, while in antennas for American or European use, an antenna element with a total length of 0.75 to 0.8 m is used. Accordingly, the antenna impedance ZA with respect to FM waves in this case is approximately 75 ohms.

Since an impedance matching system is used for FM waves, it is necessary to use a cable whose characteristic impedance is equal to ZA for the feeder cable 4 in order to insure matching of the antenna impedance ZA and the impedance ZC at the input terminal of the receiver set 5. In other words, it is necessary to use a coaxial feeder cable such as "3 C-2 V" cable or "2.5-2 V" cable.

However, the electrostatic capacitance of such coaxial feeder cables is approximately 67 pF/m. Accordingly, the attenuation of AM waves is extremely large, so that AM reception sensitivity drops.

In other words, when the antenna element 1 set at one of the above mentioned lengths, it is extremely short for AM waves, and thus becomes a high-impedance (capacitive) antenna. As a result, the voltage arising in the antenna element 1 is divided by the electrostatic capacitance CA and CB which are present between the antenna element 1 and the ground as shown in the equivalent circuit diagram in FIG. 11. Accordingly, the AM attenuation GA (−dB) can be expressed by the following equation:

$$GA=20\log_{10}\{CA/(CA+CB)\}$$

Here, CA is the electrostatic capacitance between the antenna and ground, and CB is the sum of the electrostatic capacitance CN of the attachment parts and the electrostatic capacitance CC of the feeder cable.

In the above equation, CA is determined by the length of the antenna element, and may be viewed as fixed. Accordingly, in order to reduce the attenuation GA, it is necessary to minimize CB. In this case, CN is a structurally determined fixed value; accordingly, it is necessary to minimize CC.

If D1 is the external diameter of the core conductor 41 of the coaxial feeder cable 4 and D2 is the internal diameter of the outer conductor 42 of the feeder cable 4, as shown in FIG. 12, then the electrostatic capacitance C per unit length of the cable 4 can be expressed by the following equation:

$$C=2\pi\cdot\epsilon 0\cdot\epsilon s/\log e(D2/D1)$$

Accordingly, the electrostatic capacitance C can be reduced by increasing the ratio of D2 to D1. However, since the characteristic impedance of the coaxial feeder cable 4 can be expressed by the equation shown below, the characteristic impedance increases when the ratio is increased.

$$Z = \log e(D2/D1)\cdot 60/\sqrt{\epsilon}$$

Accordingly, if such a coaxial feeder cable 4 is connected to the antenna element 2, impedance mismatching will occur with respect to FM waves, so that the FM reception sensitivity drops.

Thus, in the past, there has been no special technical means for receiving both AM and FM waves with good sensitivity. In most cases, the sensitivity for one or the other has been poor. Furthermore, a drop in the reception sensitivity of antenna systems has been a particular problem in recent years. The reason for drops in sensitivity is because since in recent years various types of electrical products which are now widely used, noise levels have increased. As a result, there has been deterioration in S/N ratios. This sensitivity drop has created various problems, such as a serious reduction or limitation of listening ranges for radio listeners.

Meanwhile, there has been a demand for smaller size and lighter weight automobile antennas. For example, there has been a strong demand for rod antennas to be shorter so as to prevent them from being damaged by obstacles such as the branches of trees, etc. Such demands generally lead to a drop in reception sensitivity.

However, decreases in current levels of reception sensitivity are not acceptable and the increased cost of meeting the current demands as described above would also not be readily tolerated.

SUMMARY OF THE INVENTION

Accordingly, it is a primary object of the present invention to provide an automobile antenna which has the same AM reception sensitivity as in the past, and achieves a great improvement in FM reception sensitivity.

It is another object of the present invention to provide an automobile antenna which is extremely useful in cases where, for example, the antenna is used in combination with a receiver set equipped with an electronic tuning system.

The present invention provides an antenna without altering the structure of the conventional antenna and without increasing manufacturing costs.

The antenna of the present invention includes an antenna element which is attached to a vehicle body so that the antenna element can receive AM and FM waves, and a feeder cable, one end of which is connected to the feeding point of the antenna element, and the other end to a receiver set. The length of the feeder cable is an integral multiple of ½ of the wavelength of the FM band.

In the present invention, the length of the feeder cable is not set at the physically required mechanical length, but rather in terms of the electrical length at an integral multiple of ½ of the wavelength of the FM broadcast band. Accordingly, impedance matching can be achieved regardless of the characteristic impedance of the feeder cable. As a result, impedance matching for FM waves can be obtained in a favorable manner while AM attenuation is simultaneously suppressed by using a high-impedance feeder cable which has a small electrostatic capacitance per unit length of the cable.

DETAILED DESCRIPTION OF THE INVENTION

Figure 1:
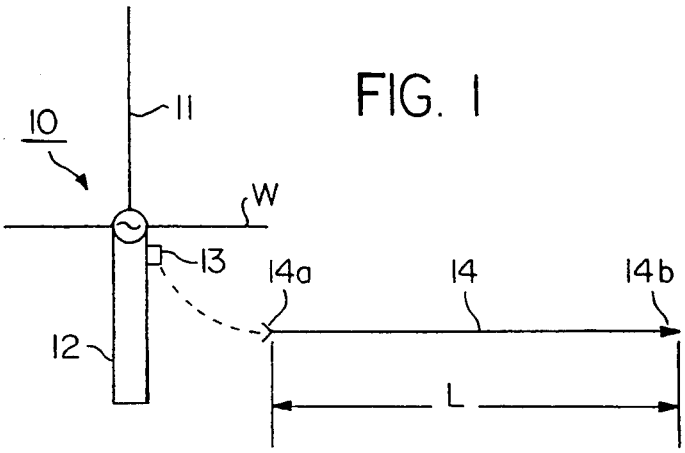
FIG. 1 illustrates the structure of the antenna of the present invention.

In FIG. 1, an automobile antenna 10 is attached to the body wall W of a vehicle. In this antenna 10, a rod antenna element 11 which is capable of receiving both AM and FM waves is accommodated inside a housing tube 12 which is installed inside the vehicle so that the antenna element 11 can be freely extended and retracted. One end 14*a* of a coaxial feeder cable 14 is connected to a feeding point 13 of the antenna 10. The other end 14*b* of this feeder cable 14 is connected to a receiver set (not shown). The length L of the feeder cable 14 is set at an integral multiple of $\lambda/2$, where $\lambda$ is the wavelength of the FM waves received. In other words, the cable length is set in terms of electrical length.

As a result of the cable length being set at an integral multiple of $\lambda/2$ as described above, the following effect is obtained.

The impedance values at both ends of the cable are equal. Accordingly, when the length of the feeder cable 14 is set at an integral multiple of $\lambda/2$, the impedance values at every position on the feeder cable 14 corresponding to an integral multiple of $\lambda/2$ will all be ZA if the antenna impedance is ZA. As a result, the impedance at the other end 14*b* of the feeder cable 14, i.e., the end at which the feeder cable is connected to the receiver set will also be ZA. This is true regardless of the impedance of the cable 14 itself. Accordingly, the feeder cable 14 itself may consist of a cable with any desired impedance. In other words, there is no need to use a feeder cable 14 with an impedance of 75 ohms on the grounds that the antenna impedance ZA with respect to FM waves is 75 ohms.

In determining the actual cable length, it is necessary to take cable shrinkage into account. Furthermore, if the cable length is set at a length that is shorter than the lengths currently used, it will become impossible to obtain the proper installation relationship. Accordingly, in terms of physical, the length of the cable should be set at a value that is longer than the lengths (e.g. 4.1 m, etc.) currently used in such antennas. For example, the electrical length ) $\lambda/2$ for the center frequency (84 MHz) of the 76 to 92 MHz band is approximately 1.517 m. Accordingly, a length that is three times the electrical length $\lambda/2$ is selected, and the cable length is set at 4.55 m.

Figure 2A:
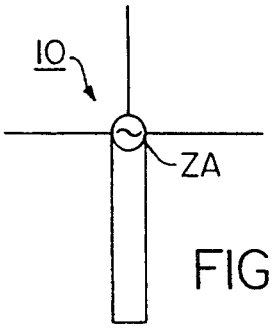
FIGS. 2(*a*), 2(*b*) and 2(*c*) illustrate the antenna of the present invention, a conventional feeder cable and an example of the feeder cable of the present invention, respectively.
Figure 2B:
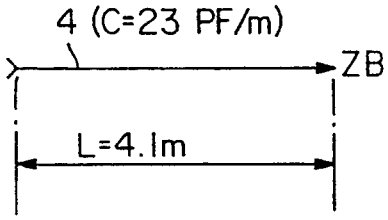
Figure 2C:
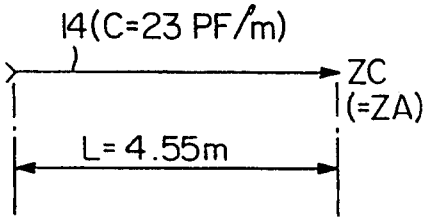
Figure 3A:
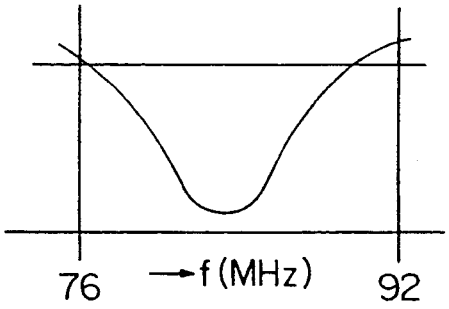
FIGS. 3(*a*), 3(*b*) and 3(*c*) are graphs showing SWR characteristics which correspond to FIGS. 2(*a*), 2(*b*) and 2(*c*), respectively.
Figure 3B:
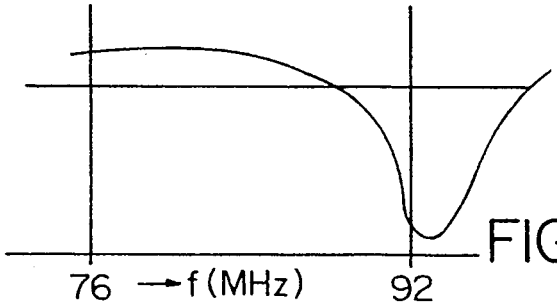
Figure 3C:
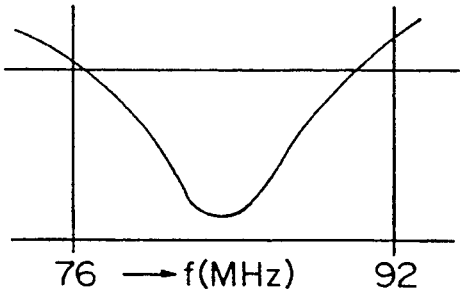

FIGS. 2(*a*), 2(*b*) and 2(*c*) show the antenna 10, a conventional feeder cable 4 whose length is set in terms of the required physical length of the cable, and the feeder cable 14 of the present invention, whose length is set in terms of the electrical length. FIGS. 3(*a*), 3(*b*) and 3(*c*) show SWR characteristics corresponding to FIGS. 2(*a*), 2(*b*) and 2(*c*), respectively.

In cases where a cable having a cable length as shown in FIG. 2(*b*) is used, the cable terminal impedance ZB is larger than the antenna impedance ZA according to the quarter-wavelength matching theory, so that mismatching occurs. As a result, the SWR characteristics are shifted in the high-frequency direction as shown in FIG. 3(*b*), so that the SWR is poor in the FM band.

On other hand, in cases where a cable with a cable length such as that shown in FIG. 2(*c*) is used, the cable terminal ZC impedance is equal to ZA. Accordingly, as is shown in FIG. 3(*c*), the SWR in the FM band is favorable.

Figure 4:
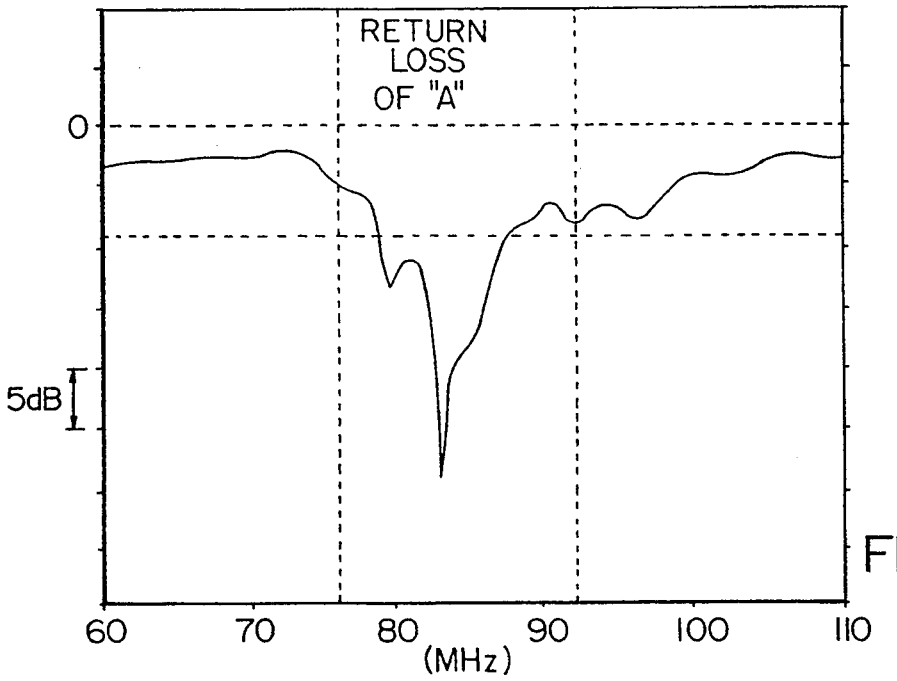
FIG. 4 is a graph which shows the return loss characteristics of a sample antenna "A" of the present invention.

Several experiments were conducted, wherein an antenna "A" with an element length of 0.95 m was used as the antenna 10. Two different cables were prepared for use as the feeder cable connected to this antenna, i.e. a conventional cable "B" with a physical length of 4.1 m, and a cable "C" of the present invention with an electrical length of 3 $\lambda/2 \approx 4.55$ m. Cable "B" or cable "C" was selectively connected to the antenna "A", and the return loss (SWR) characteristics and antenna sensitivity were measured. The results obtained were as follows:

The return loss (SWR) characteristics measured for the antenna "A" as is shown in FIG. 4.

Figure 5:
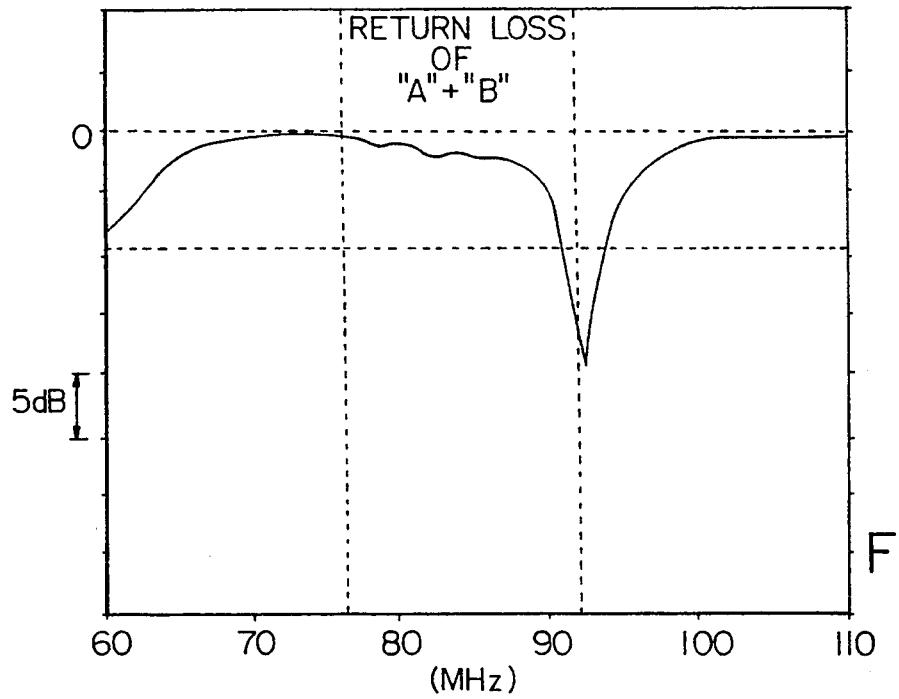
FIG. 5 is a graph which shows the return loss characteristics measured when a sample cable "B" is connected to the antenna "A"

The return loss (SWR) characteristics measured for the antenna "B" as is shown in FIG. 5.

Figure 6:
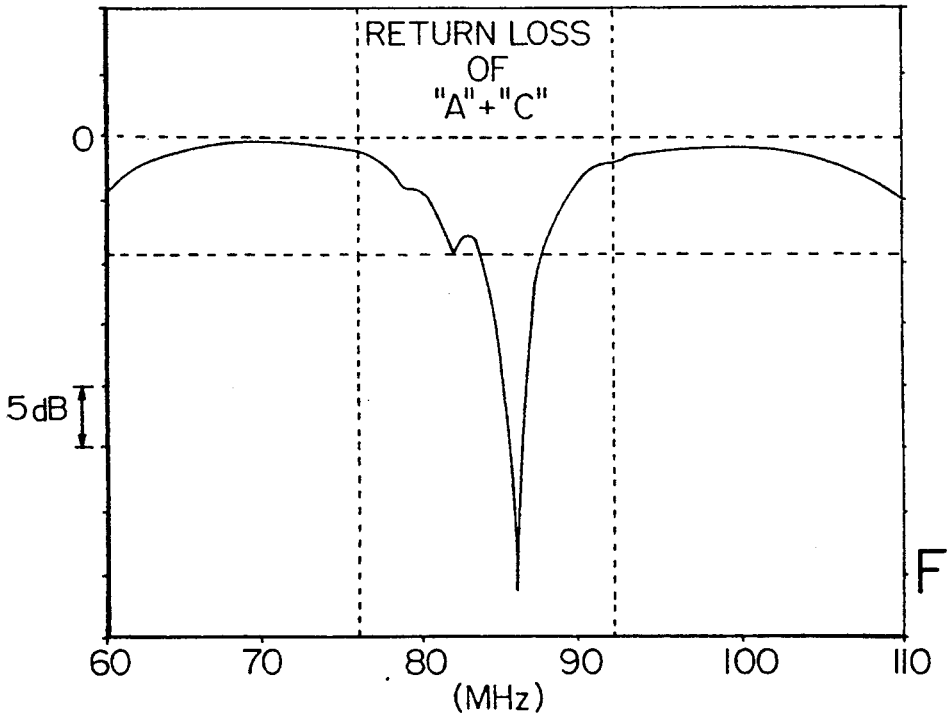
FIG. 6 is a graph which shows the return loss characteristics measured when a sample cable "C" is connected to the antenna "A"

The return loss (SWR) characteristics measured when the cable "C" was connected to the antenna "A" as is shown in FIG. 6.

FIGS. 4 through 6 correspond to FIGS. 3 (*a*), 3 (*b*) and 3 (*c*), respectively.

Figure 7:
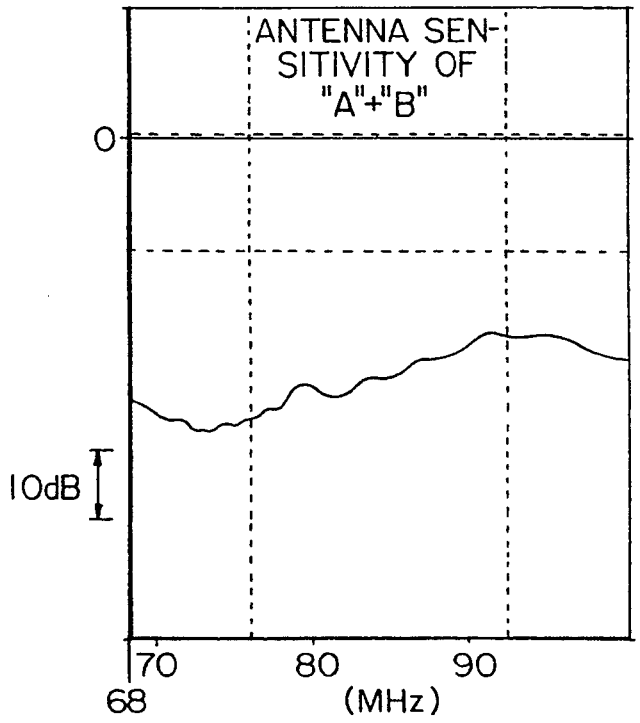
FIG. 7 is a graph which shows the antenna sensitivity measured when the cable "B" is connected to the antenna "A"

FIG. 7 is a graph which shows the antenna sensitivity measured when the cable "B" is connected to the antenna "A".

Figure 8:
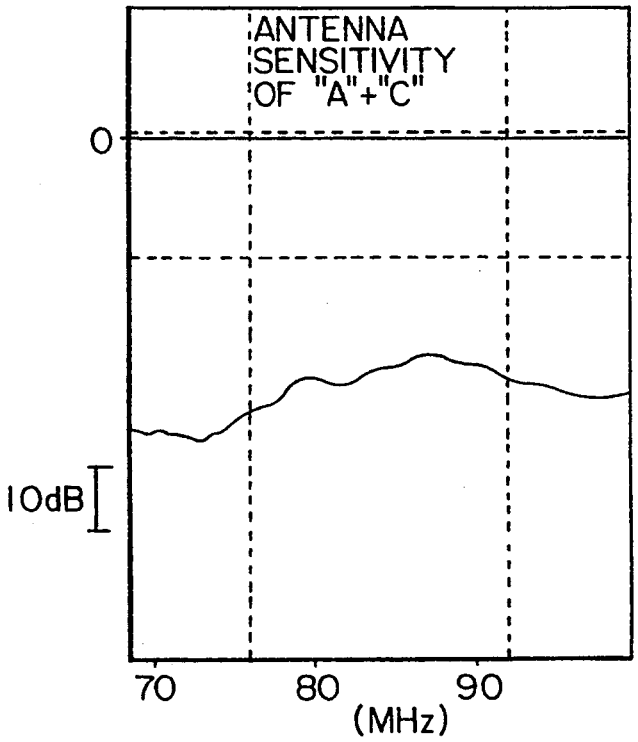
FIG. 8 is a graph which shows the antenna sensitivity measured when the cable "C" is connected to the antenna "A"

FIG. 8 is a graph which shows the antenna sensitivity measured when the cable "C" is connected to the antenna "A".

Table 1 shows numerical values for the antenna sensitivity measurement results in FIG. 7 and the antenna sensitivity measurement results in FIG. 8 in the principal measurement range, i.e. 76 to 92 MHz.

TABLE 1

| Frequency MHz | Conventional Cable "B" −dB m | Cable of Present Invention "C" −dB m | Improvement in Relative Sensitivity (−dB m) |
|---|---|---|---|
| 76 | −45.9 | −42 | +3.9 |
| 78 | −44.0 | −39.5 | +4.5 |
| 80 | −40.6 | −35.7 | +4.9 |
| 82 | −42.2 | −36.2 | +6.0 |
| 84 | −39.3 | −33.5 | +5.8 |
| 86 | −37.8 | −33.5 | +4.3 |
| 88 | −36.4 | −33.5 | +2.9 |
| 90 | −34.1 | −34.5 | −0.4 |
| 92 | −33.3 | −36.5 | −2.8 |

As is clear from Table 1, the relative sensitivity can be improved considerably if the cable "C" of the present invention is used. Feeder cables which are currently in common use have an electrostatic capacitance of 30 pF/m, 41 pF/m or 67 pF/m (emphasis on FM). Conventionally, therefore, AM attenuation caused by the electrostatic capacitance has been a problem. In the embodiments of the present invention, a cable with an electrostatic capacitance of less than 30 pF/m, e.g., a cable with an electrostatic capacitance of approximately 23 pF/m as described above can be used. Accordingly, the attenuation in the AM band can be reduced to a satisfactory value. In other words, the AM band sensitivity can be improved.

Figure 9:
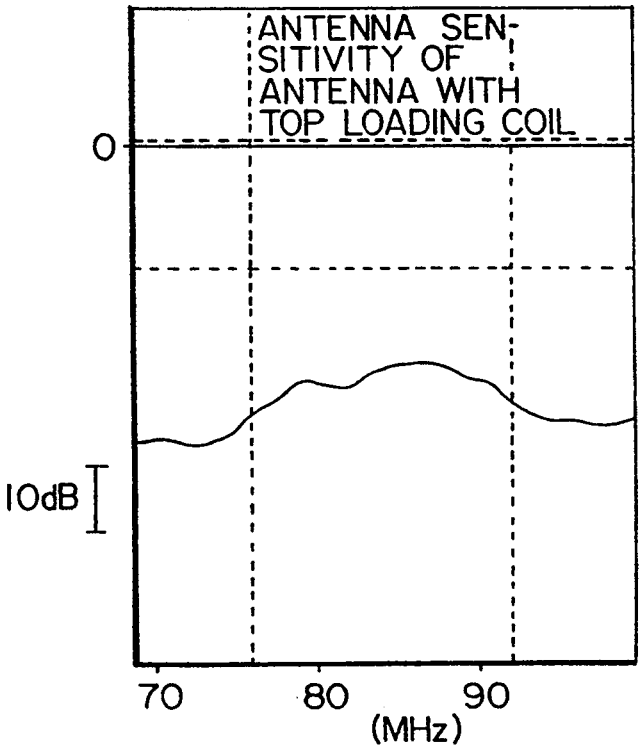
FIG. 9 is a graph which shows the antenna sensitivity measured when the cable "C" is connected to an antenna with a top loading coil.
Figure 10:
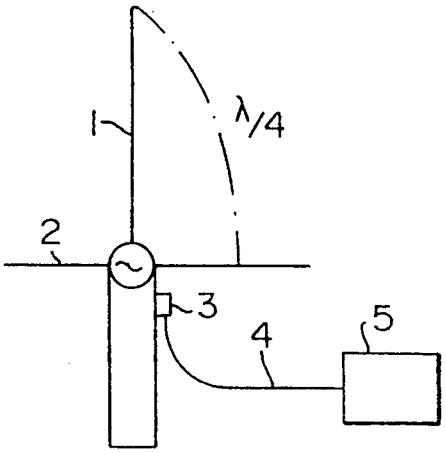
FIG. 10 PRIOR ART
FIGS. 10, 11 and 12 are diagrams which illustrate conventional antenna systems.
Figure 11:
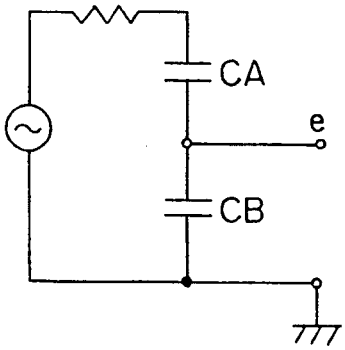
FIG. 11 PRIOR ART
Figure 12:
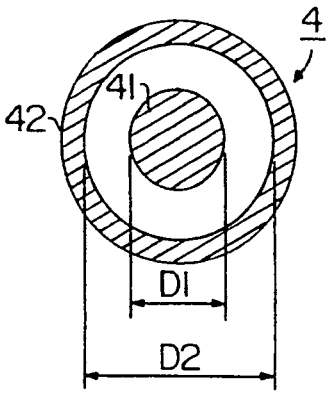
FIG. 12 PRIOR ART

FIG. 9 shows the sensitivity measured in a case where an antenna equipped with a top loading coil, i.e. an antenna in which a loading coil is installed at the top end of the antenna element in order to prevent accidental damage to the antenna element, etc. was used as the antenna 10, and the cable "C" was connected to this antenna. As is clear from the Figure, use of the cable "C" makes it possible to improve reception sensitivity in the range of 76 to 92 MHz, compared to the sensitivity of a conventional antenna with an element length of 0.95 m even in the case of an antenna equipped with a top loading coil.

The present invention is not limited to the embodiments described above. It goes without saying that various modifications are possible as long as there is no departure from the spirit and the scope of the present invention.

In the present invention, a cable whose electrical length is set at an integral multiple of $\frac{1}{2}$ the wavelength of the FM waves received is used as a feeder cable. Accordingly, the antenna is able to maintain AM reception sensitivity at at least the same levels obtained in the past, and achieve a great improvement in FM reception sensitivity. Furthermore, the antenna is extremely useful if it is used in combination with a receiver set equipped with electronic tuning, and the present invention achieves these goals without altering the conventional structure of antenna or increasing the manufacturing costs.

We claim:

1. An AM/FM broadcast band automobile antenna comprising: an antenna element provided on a vehicle body and having an input impedance in an FM broadcast band substantially less than an input impedance of said antenna element in an AM broadcast band, said antenna element for receiving said AM and FM broadcast bands and a feeder cable having one end thereof connected to a feeding point of said antenna element and the other end to an input of a receiver set, said feeder cable having an electrical length from the feeding point of said antenna element to the input of said receiver set equal to an integral multiple of $\frac{1}{2}$ the wavelength of the FM broadcast band and said feeder cable further comprising a coaxial cable whose impedance is substantially greater than said input impedance of said antenna element in said FM broadcast band and whose electro static capacitance per unit length is less than 30 pf/m, whereby not only is the sensitivity of the automobile antenna in the AM broadcast band increased, but also the sensitivity in the FM broadcast band increased.

2. An automobile antenna comprising an antenna element provided on a vehicle body, said antenna element receiving both AM and FM broadcast bands, said antenna element having an electrical length which is an integral multiple of $\frac{1}{4}$ the wavelength of the FM broadcast band and having an input impedance in the FM broadcast band substantially less than an input impedance in the AM broadcast band, and a feeder cable having one end thereof connected to a feeding point of said antenna element and the other end connected to an input of a receiver set, wherein the length L of said feeder cable from the feeding point of said antenna element to the input of the receiver set is set as follows:

$$L = N \times \lambda/2$$

in which N is an integer and $\lambda$ is the wavelength of FM broadcast band waves, and said feeder cable comprising a coaxial cable whose impedance is substantially greater than said input impedance of said antenna element in said FM broadcast band and whose electro static capacitance per unit length is less than 30 pf/m, whereby not only is the sensitivity of the automobile antenna in the AM broadcast band increased, but also the sensitivity in the FM broadcast band is increased.

* * * * *